US011110308B1

(12) United States Patent
Paulin

(10) Patent No.: US 11,110,308 B1
(45) Date of Patent: Sep. 7, 2021

(54) FIREPROOF HOLE PLUG ASSEMBLY

(71) Applicant: Valmont Industries, Inc., Omaha, NE (US)

(72) Inventor: Robert Paulin, Irmo, SC (US)

(73) Assignee: Valmont Industries, Inc., Omaha, NE (US)

( * ) Notice: Subject to any disclaimer, the term of this patent is extended or adjusted under 35 U.S.C. 154(b) by 0 days.

(21) Appl. No.: 17/006,984

(22) Filed: Aug. 31, 2020

Related U.S. Application Data

(60) Provisional application No. 62/899,376, filed on Sep. 12, 2019.

(51) Int. Cl.
*A62C 2/06* (2006.01)

(52) U.S. Cl.
CPC ..... *A62C 2/065* (2013.01)

(58) Field of Classification Search
USPC ..... 52/98, 514, 741.41
See application file for complete search history.

(56) References Cited

U.S. PATENT DOCUMENTS

RE26,192 E * 4/1967 Martin ..... B21D 37/205 83/665
4,301,629 A * 11/1981 Farr ..... B62D 25/24 217/109
5,037,324 A * 8/1991 Scheffey, Sr. ..... H01R 13/639 439/452
5,103,615 A * 4/1992 Owens ..... E04B 1/72 52/169.14
5,697,510 A * 12/1997 Wang ..... B65D 51/1683 215/262
6,360,779 B1 * 3/2002 Wagner ..... F16L 55/105 138/89
2012/0152950 A1 * 6/2012 Al-Subaiey ..... B65D 88/38 220/219

* cited by examiner

*Primary Examiner* — Joshua K Ihezie
(74) *Attorney, Agent, or Firm* — Milligan PC LLO

(57) ABSTRACT

The present invention provides fire protection for pole access points and pole interiors. In accordance with preferred embodiments, the present invention provides a fireproof hole plug assembly which includes an intumescent gasket and a securing fireproof hole plug. According to further preferred embodiments, the intumescent gasket of the present invention is preferably cut to fit the fireproof hole plug and positioned to act as a barrier between the access point and external heat sources.

14 Claims, 6 Drawing Sheets

FIREPROOF HOLE PLUG ASSEMBLY

RELATED APPLICATIONS

The present application claims priority to U.S. Provisional Application No. 62/899,376 filed Sep. 12, 2019.

FIELD OF THE PRESENT INVENTION

The present invention relates generally to an improved fireproof hole plug assembly. More specifically, the present invention relates to an improved fireproof hole plug and hole plug assembly for protecting the interior of a utility pole.

BACKGROUND OF THE INVENTION

Traditional utility poles are single, vertical columns or posts enclosing a central cavity. Utility poles are commonly erected at regular intervals to support overhead power lines and other public utilities such as electrical cable, fiber optic cable, and related equipment such as transformers and street lights. In this capacity, utility poles are inexpensive ways to keep electrical wires and cables from touching the ground, and out of the way of people and vehicles.

In addition to the exterior attachment of wires, utility poles are commonly used as electrical chases for electrical wires and the like. This use of the pole interior has been increasingly common due to the use of underground distribution lines. The pole interior has also increasingly been used by wireless and cable service companies to mount their equipment above the street surface. During fires, these internal wires and cables are often at risk of damage. This can result in extensive time and expense to restore electrical power in fire impacted areas. Often, the damage to the internal wiring is the critical factor in protecting and restoring electrical power since the underground wiring and the suspended overhead lines are otherwise protected from ground fires.

To overcome the limitations of the prior art, a reliable and cost-effective apparatus is needed for safely and effectively protecting internal utility lines and cables within a utility pole interior.

SUMMARY OF THE PRESENT INVENTION

To address the shortcomings presented in the prior art, the present invention provides fire protection for pole access points and pole interiors. In accordance with preferred embodiments, the present invention provides a fireproof hole plug assembly which includes an intumescent gasket and a securing fireproof hole plug. According to further preferred embodiments, the intumescent gasket of the present invention is preferably cut to fit the fireproof hole plug and positioned to act as a barrier between the access point and external heat sources.

Other goals and advantages of the invention will be further appreciated and understood when considered in conjunction with the following description and accompanying drawings. While the following description may contain specific details describing particular embodiments of the invention, this should not be construed as limitations to the scope of the invention but rather as an exemplification of preferable embodiments. For each aspect of the invention, many variations are possible as suggested herein that are known to those of ordinary skill in the art. A variety of changes and modifications can be made within the scope of the invention without departing from the spirit thereof.

BRIEF DESCRIPTION OF THE DRAWINGS

Elements in the figures have not necessarily been drawn to scale in order to enhance their clarity and to improve the understanding of the various elements and embodiments of the invention. Furthermore, elements that are known to be common and well understood to those in the industry are not depicted in order to provide a clear view of the various embodiments of the invention. Thus, it should be understood that the drawings are generalized in form in the interest of clarity and conciseness.

DESCRIPTION OF THE PREFERRED EMBODIMENTS

Aspects of the present invention will be explained with reference to exemplary embodiments and examples which are illustrated in the accompanying drawings. These descriptions, embodiments and figures are not to be taken as limiting the scope of the claims. Further, the word "exemplary" is used herein to mean "serving as an example, instance, or illustration." Accordingly, any embodiment described herein as"exemplary" is not to be construed as preferred over other embodiments. Additionally, well-known elements of the embodiments will not be described in detail or will be omitted so as not to obscure relevant details.

Where the specification describes advantages of an embodiment or limitations of other prior art, the applicant does not intend to disclaim or disavow any potential embodiments covered by the appended claims unless the applicant specifically states that it is "hereby disclaiming or disavowing" potential claim scope. Likewise, the term "embodiments" does not require that all embodiments of the invention include any discussed feature or advantage, nor that it does not incorporate aspects of the prior art which are sub-optimal or disadvantageous.

As used herein, the singular forms "a" "an" and "the" are intended to include the plural forms as well, unless the context clearly indicates otherwise. Additionally, the word "may" is used in a permissive sense (i.e., meaning "having the potential to'), rather than the mandatory sense (i.e. meaning "must"). Further, it should also be understood that throughout this disclosure, unless logically required to be otherwise, where a process or method is shown or described, the steps of the method may be performed in any order (i.e. repetitively, iteratively or simultaneously) and selected steps may be omitted. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

With reference now to FIGS. 1-6, the present invention teaches a system, method and apparatus which includes an improved, fireproof hole plug 10 and fireproof hole plug assembly 15. As should be understood, the examples discussed herein are intended to be illustrative and any of a variety of alternative systems, embodiments and/or configurations may be used with the present invention without limitation.

Figure 1:
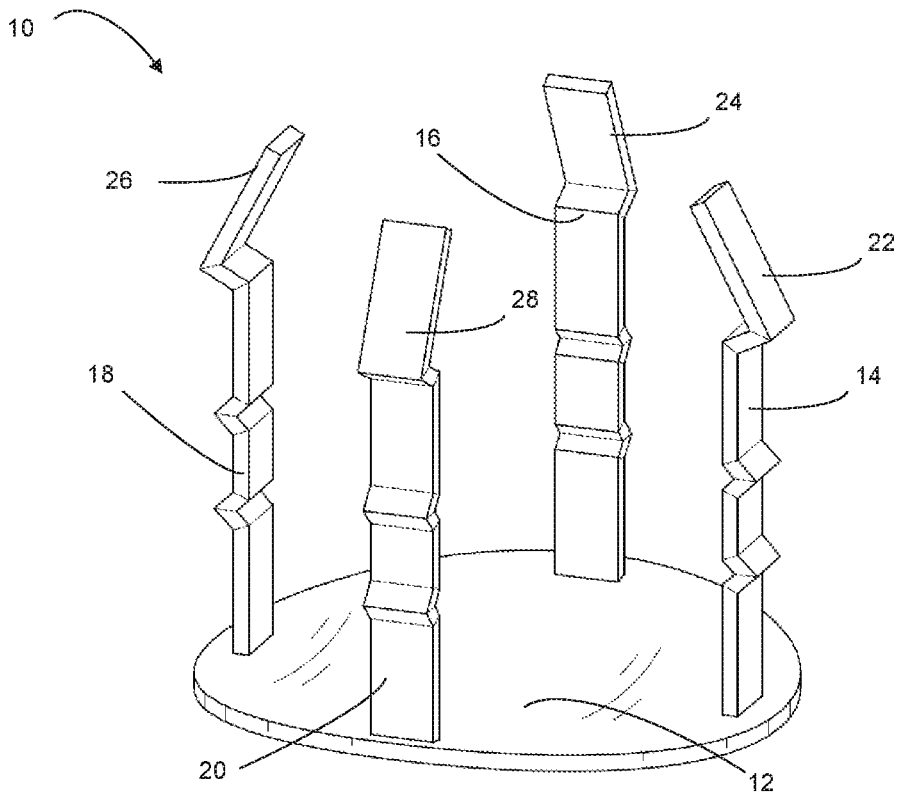
FIG. 1 is a first perspective view of one embodiment of an exemplary fireproof hole plug in accordance with the present invention.
Figure 2:
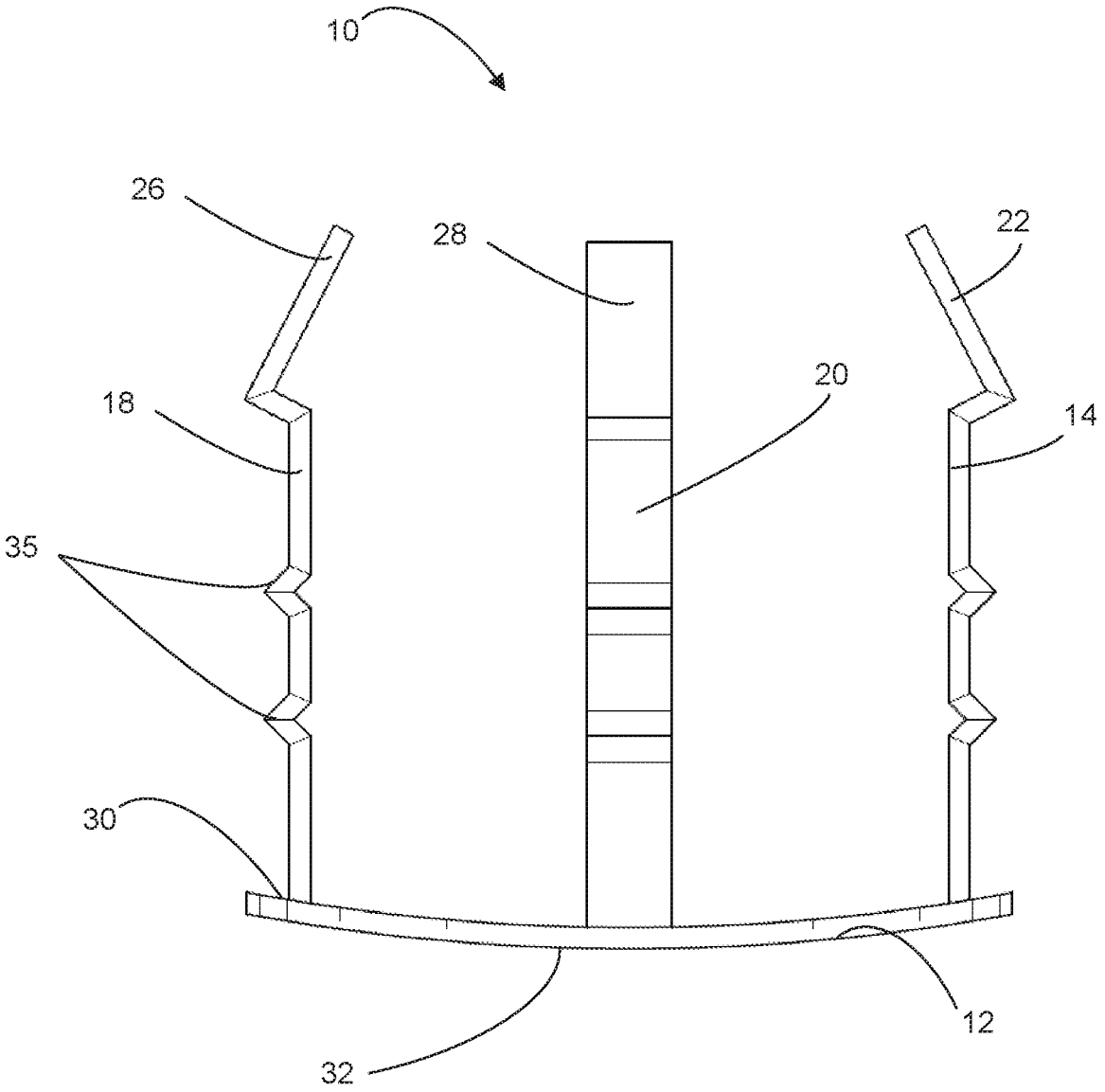
FIG. 2 is a side elevation view of the embodiment shown in FIG. 1.

With reference now to FIGS. 1 and 2, an exemplary embodiment of the present invention shall now be discussed. As shown, an exemplary fireproof hole plug 10 of the present invention may a generally curved main body 12 formed of a durable, hardened material. According to a preferred embodiment, the main body 12 may be formed of stainless steel, galvanized steel or the like. The main body 12 may preferably further include an interior surface 30 and an exterior surface 32. According to alternative preferred embodiments, the interior surface 30 and the exterior surface 32 may be identical or may be formed and/or coated with different materials. For example, the main body 12 may be formed of stainless steel or the like, and the exterior surface 32 may be coated with an intumescent paint or the like. Although the main body 12 is shown as a generally circular surface, the shape of the main body 12 may alternatively be oval, square, or any of a range of other polygonal shapes without limitation.

As shown in FIGS. 1 and 2, the example fireproof hole plug 10 of the present invention includes legs 14, 16, 18 and 20. According to a preferred embodiment, the legs 14-20 may preferably be formed of flexible material (e.g. thin metal) which allows the legs 14-20 to bend inwardly in response to pressure applied to any of their respective distal ends 22, 24, 26, 28. As shown, the respective distal ends 22-28 of each leg 14-20 are preferably formed at an angle to the main axis of each leg 14-20 so that the application of force to the distal ends 22-28 will act to bend each leg 14-20 to the center of the fireproof hole plug 10. Preferably, each leg 14-20 also includes one or more retaining surfaces 35 which extend outward from the surface of each leg 14-20. According to alternative embodiments, the number of legs may preferably be varied to include between two and 10 total legs. The lengths of the legs 14-20 may be uniform or may vary between each leg. The preferred length of each leg 14-20 may preferably be in the range of 0.25 to 3 inches but may alternatively vary to fit the wall thickness of any given pole.

Figure 3:
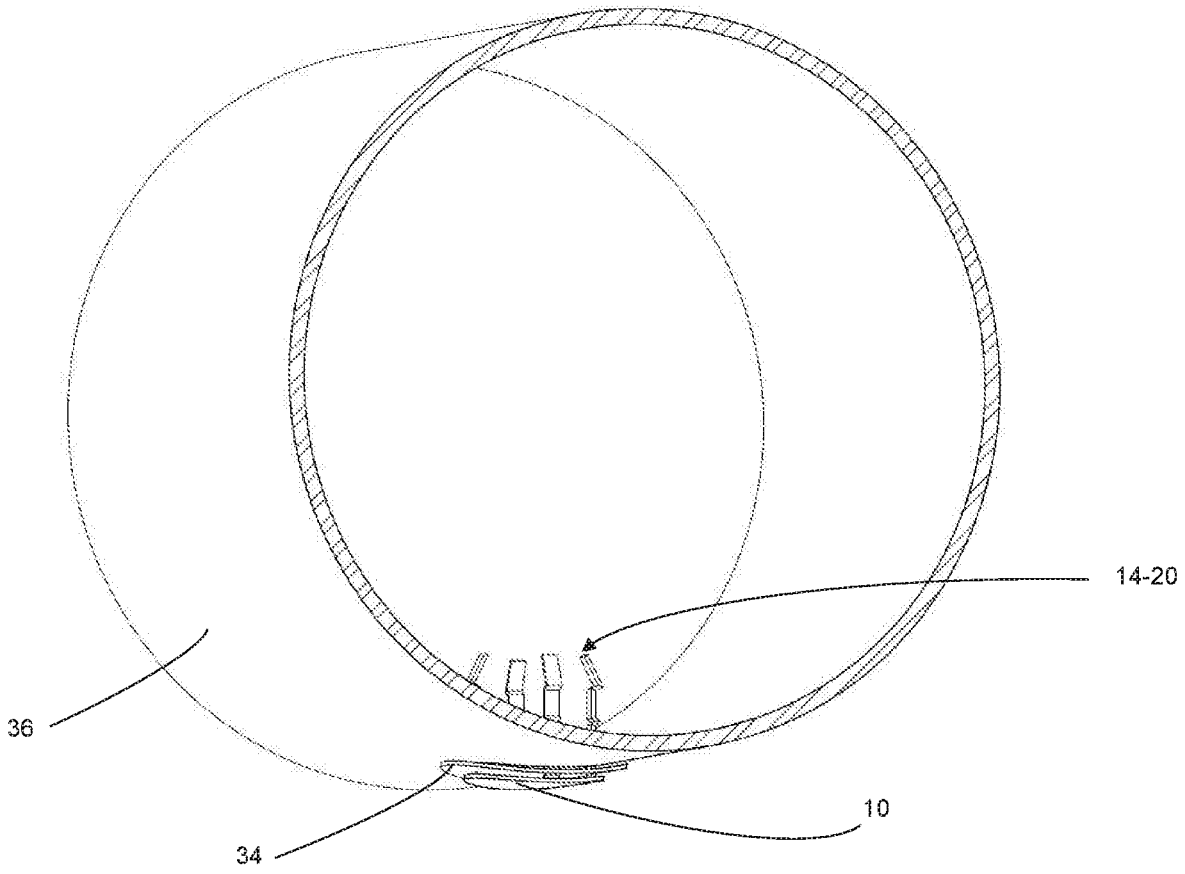
FIG. 3 is a perspective view of an exemplary fireproof hole plug assembly of the present invention secured within a utility pole.
Figure 4:
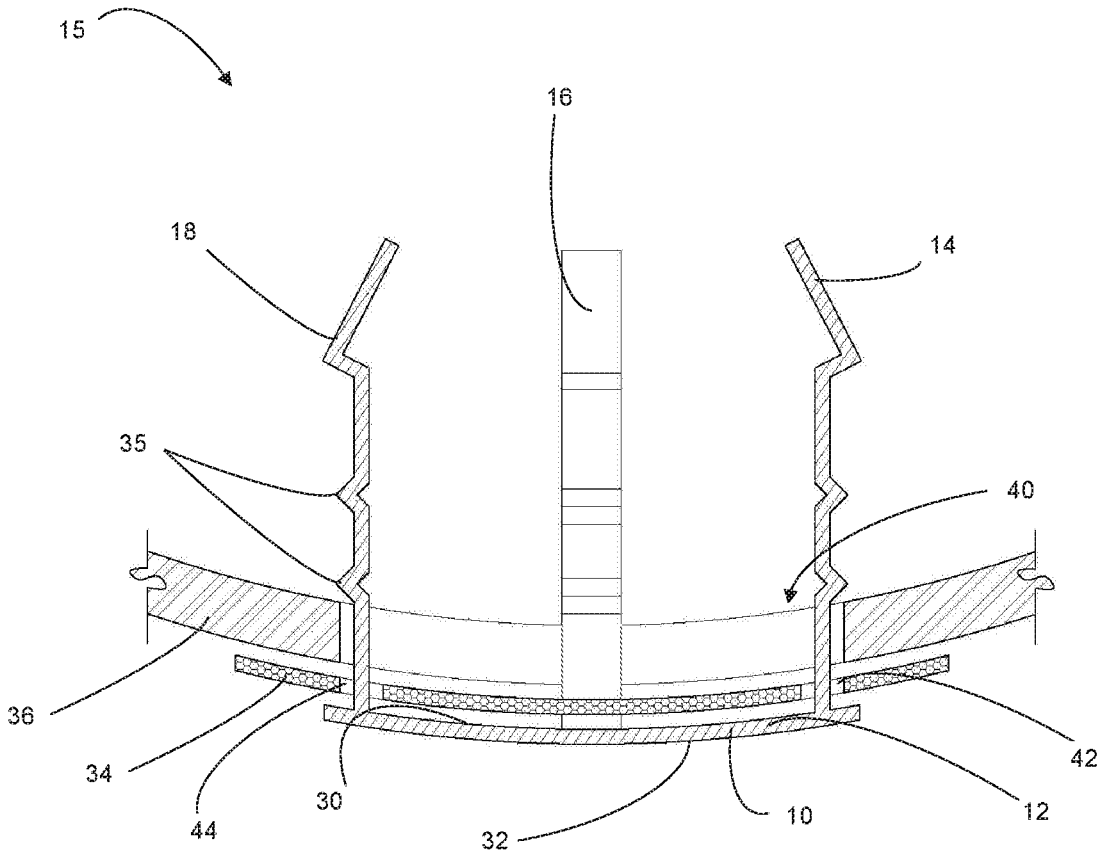
FIG. 4 is a side cross-sectional view of e utility pole and fireproof hole plug assembly shown in FIG. 3.

With reference now to FIGS. 3-4, an exemplary fireproof hole plug assembly 15 is shown inserted within an exemplary pole wall 36. With reference to FIG. 3, a perspective view is provided showing the fireproof hole plug 10 with legs 14-20 inserted through an access point 40 (shown in FIG. 4) so that the interior surface 30 (shown in FIG. 4) of the fireproof hole plug 10 conforms closely to the surface of the exemplary pole wall 36. As shown in the cross-sectional view provided in FIG. 4, the individual legs 14-20 are preferably inserted to a sufficient depth so that the retaining surfaces 35 of each leg 14-20 are within the pole wall 36 and able to hold the fireproof hole plug 10 against the pole wall 36.

As shown in FIG. 3, an intumescent gasket 34 is preferably provided and secured between the fireproof hole plug 10 and the pole wall 36. As shown, the intumescent gasket 34 preferably includes a plurality leg slits 42, 44 for receiving and allowing each leg 14-20 to pass through the intumescent gasket 34 and into the interior of the pole wall 36. According to a first preferred embodiment, the intumescent gasket 34 may have a diameter in the range of 1-5 inches which preferably extends beyond the diameter of the fireproof hole plug 10. According to a further preferred embodiment, the intumescent gasket 34 may have a diameter of 1½ inches and the main body 12 of the fireproof hole plug 10 may have a diameter of 1⅜ inches. Preferably, the intumescent gasket 34 may have a thickness in the range of 0.1 mm to any thickness (e.g. 0.2-10 mm or more). According to a preferred embodiment, the intumescent gasket 34 may have a thickness of 2 mm. The intumescent gasket 34 may be cut with an exterior shape which matches the shape of the fireproof hole plug 10. Alternatively, the intumescent gasket 34 may be differently shaped. For example, the fireproof hole plug 10 may be circular and the intumescent gasket 34 may be rectangular.

According to a first preferred embodiment, the intumescent gasket 34 may preferably, be formed of fireproof or fire resistant material such as poly benzimidazole (PBI) or polyhydroquinone fiber or the like. Alternatively, the intumescent gasket 34 may be formed of other materials such as meta or para-aramid fibers (i.e. Nomex, Kevlar, Taparan, Kermel, X-Fiber and the like), fire-resistant cotton, coated nylon, carbon foam (CFOAM), and/or other intumescent materials.

Figure 5:
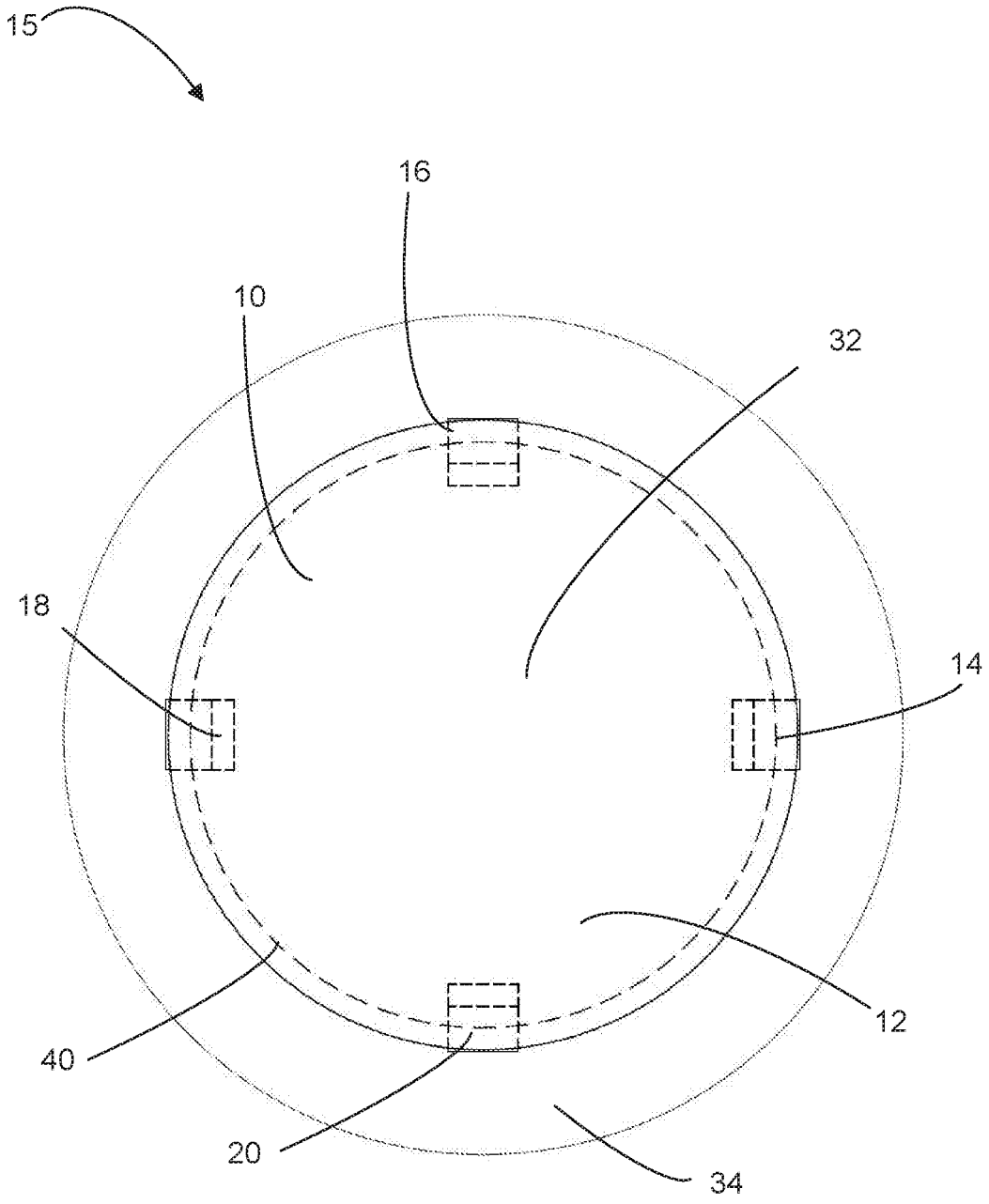
FIG. 5 is a top-down view of one embodiment of an exemplary fireproof hole plug assembly in accordance with the present invention.
Figure 6:
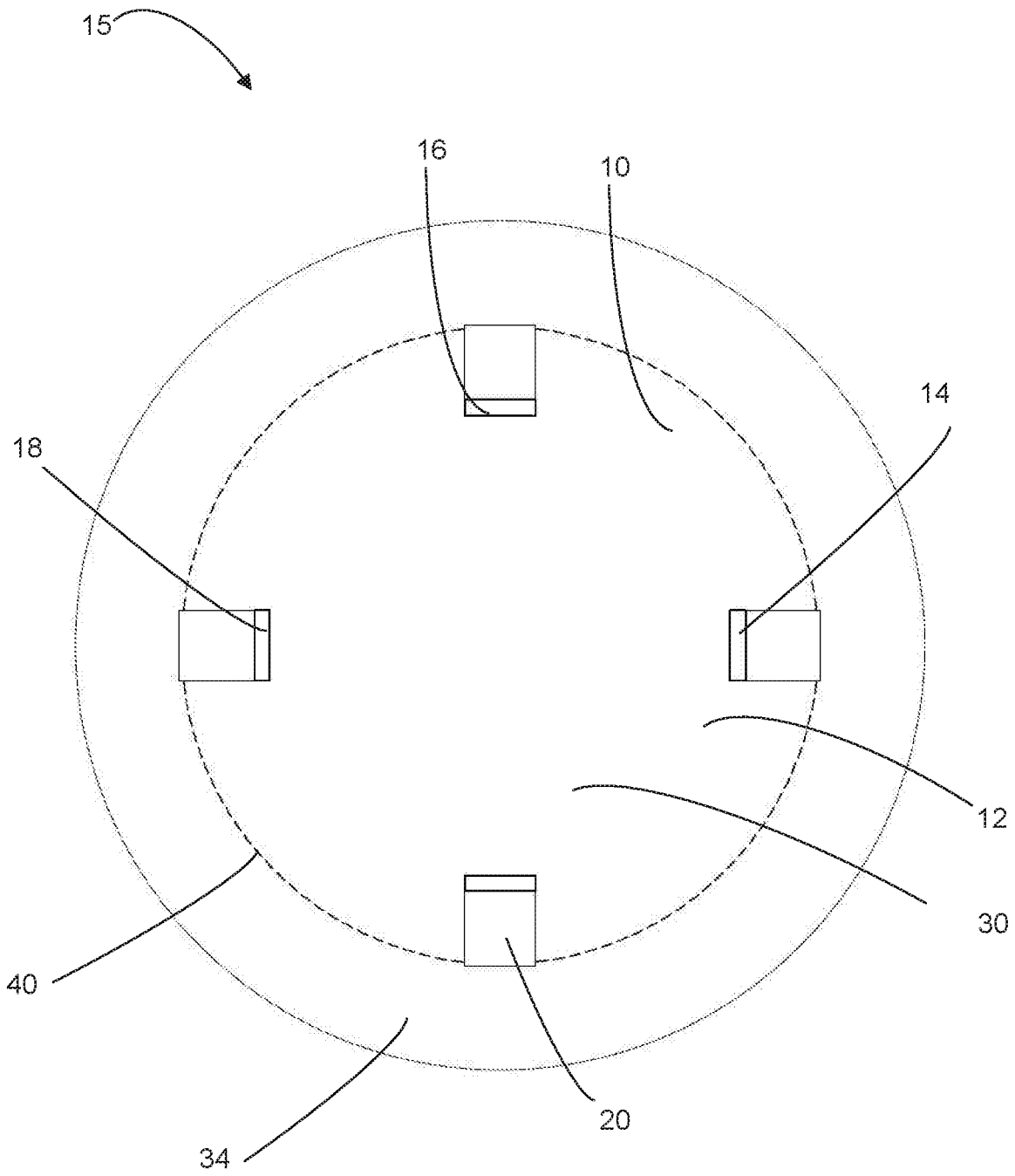
FIG. 6 is a bottom view of an alternative embodiment of an exemplary fireproof hole plug assembly in accordance with the present invention.

With reference to FIG. 5, a top-down view of the exemplary fireproof hole plug assembly 15 is provided. As shown, the legs 14-20 are inserted through the access point 40 and extended to provide a tight, frictional fit. According to alternative preferred embodiments, the fireproof hole plug assembly 15 may also be attached using other means such as using magnetic or mechanical fasteners (e.g. screws, bolts and the like) without limitation. The exterior surface 32 of the fireproof hole plug 10 preferably sits atop of the intumescent gasket 34 which preferably extends beyond the edges of the fireproof hole plug 10. With reference to FIG. 6, a bottom-up view of the same fireproof hole plug assembly 15 is provided showing the interior surface 30.

According to further aspects of the present invention, the tight, frictional fit between the fireproof hole plug 10 and the intumescent gasket 34 protects the access point 40 of the utility pole. At the same time, the frictional fit is preferably flexible enough to allow the fireproof hole plug 10 to be removed and/or adjusted by hand or pried up with a blade edge or the like.

The present invention has been disclosed above with reference to several examples. These examples are not intended to be limiting. Instead, the scope of the present invention should be determined purely by the terms of the appended claims and their legal equivalents.

What is claimed is:

1. An improved fireproof hole plug assembly for protecting a pole which includes a pole wall and an access point for accessing the interior of the pole, wherein the fireproof hole plug assembly comprises:

a main body, wherein the main body comprises an inner surface and an outer surface; wherein the main body has a first circumference;

a plurality of legs, wherein each of the plurality of legs comprises a leg main body, a retaining surface and a leg head; wherein the leg head is offset from the main axis of the leg main body; and an intumescent gasket, wherein the intumescent gasket has a second circumference;

wherein the intumescent gasket comprises a plurality of leg slits configured and positioned to receive each of the plurality of legs.

2. The fireproof hole plug assembly of claim 1, wherein the intumescent gasket is positioned between the main body and the pole wall.

3. The fireproof hole plug assembly of claim 2, wherein the second circumference is greater than the first circumference.

4. The fireproof hole plug assembly of claim 2, wherein the second circumference is equal to the first circumference.

5. The fireproof hole plug assembly of claim 3, wherein each of the plurality of leg slits are configured to allow one of the plurality of legs to pass through the intumescent gasket.

6. The fireproof hole plug assembly of claim 5, wherein each of the plurality of leg slits is configured to allow one of the plurality of legs to pass through the intumescent gasket and through the pole wall.

7. The fireproof hole plug assembly of claim 6, wherein the pole wall comprises a curved outer surface; wherein the main body comprises a curved surface which is curved to approximate the curve of the pole wall.

8. The fireproof hole plug assembly of claim 6, wherein the pole wall comprises a flat outer surface; wherein the main body comprises a flat surface.

9. The fireproof hole plug assembly of claim 7, wherein the intumescent gasket has a diameter greater than 1 inch.

10. The fireproof hole plug assembly of claim 9, wherein the main body is comprised of material selected from the group of materials comprising: stainless steel, galvanized steel, and zinc.

11. The fireproof hole plug assembly of claim 10, wherein the main body comprises a layer of intumescent paint.

12. The fireproof hole plug assembly of claim 11, wherein the plurality of legs comprises a first leg; wherein the first leg comprises a proximal end connected to the main body and a distal end; wherein the first leg is formed of a flexible material; wherein the first leg is biased to bend inwardly in response to pressure applied to its distal end.

13. The fireproof hole plug assembly of claim 12, wherein the distal end of first leg is formed at an angle to a main axis of the first leg.

14. The fireproof hole plug assembly of claim 13, wherein the intumescent gasket extends beyond the first circumference of the main body.

* * * * *